US007096980B2

(12) United States Patent
Trevas

(10) Patent No.: US 7,096,980 B2
(45) Date of Patent: Aug. 29, 2006

(54) ROTARY IMPACT WELL DRILLING SYSTEM AND METHOD

(75) Inventor: David Trevas, Houston, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 272 days.

(21) Appl. No.: 10/729,130

(22) Filed: Dec. 5, 2003

(65) Prior Publication Data

US 2004/0222021 A1 Nov. 11, 2004

Related U.S. Application Data

(60) Provisional application No. 60/431,686, filed on Dec. 7, 2002.

(51) Int. Cl.
*E21B 4/14* (2006.01)

(52) U.S. Cl. ..... 175/296; 175/57; 173/91

(58) Field of Classification Search ..... 173/293, 173/93, 100, 110, 200, 201, 91; 166/177.6; 175/57, 296, 298, 293
See application file for complete search history.

(56) References Cited

U.S. PATENT DOCUMENTS

| | | | | |
|---|---|---|---|---|
| 3,307,640 | A * | 3/1967 | Cleary | 173/137 |
| 3,316,986 | A * | 5/1967 | Orr | 175/297 |
| 5,957,220 | A | 9/1999 | Coffman et al. | |
| 6,047,778 | A | 4/2000 | Coffman et al. | |
| 6,742,609 | B1 * | 6/2004 | Gillis et al. | 175/415 |

* cited by examiner

*Primary Examiner*—David Bagnell
*Assistant Examiner*—Nicole Coy
(74) *Attorney, Agent, or Firm*—Haynes and Boone, LLP

(57) ABSTRACT

A system and method for applying rotary percussive impacts to a drill bit, according to which an anvil is connected to the bit and a hammer is driven in one direction in the anvil when the bit encounters a relatively large load. Energy is stored during the movement of the hammer in the one direction and the stored energy is released to drive the hammer in a direction opposite the first direction to produce the percussive impacts.

31 Claims, 5 Drawing Sheets

ROTARY IMPACT WELL DRILLING SYSTEM AND METHOD

This application relates to, and claims priority of, co-pending provisional application 60/431,686, filed Dec. 7, 2002.

BACKGROUND OF INVENTION

The present invention relates to the drilling of well bores, and, more particularly, to the impact assisted drilling of well bores using a rotary bit connected to the end of a drilling string.

In connection with the recovery of hydrocarbons and other minerals from the earth, wells are generally drilled in an earth formation using a variety of different methods and equipment. According to a method often used, a roller cone bit or fixed cutter bit is rotated against the subsurface formation to form the well bore. The bit is rotated in the well bore through the rotation of a drill string attached to the bit and/or by the rotary force imparted to the bit by a subsurface fluid motor powered by the flow of drilling fluid through the drill string.

A problem associated with normal rotary drilling of this type, particularly when a fixed bit configuration is used, is that the bit can drag or stop rotating as a result of encountering a relatively large load in the well bore W while the attached drill string continues to turn. This alone can cause damage, and, even if the torque applied through the string eventually succeeds in breaking the bit free of the formation, the sudden release of the bit can cause it to rotate faster than the drill string. The latter phenomenon can cause problems in the operation of the drilling assembly and in the formation of the well bore but can be eliminated or reduced by reducing the weight-on-bit. However, weight-on-bit reduction may produce undesirable effects such as a reduction in the rate-of-penetration of the bit into the formation.

Therefore, what is need is a drilling system that eliminates the above problems.

DETAILED DESCRIPTION

Figure 1:
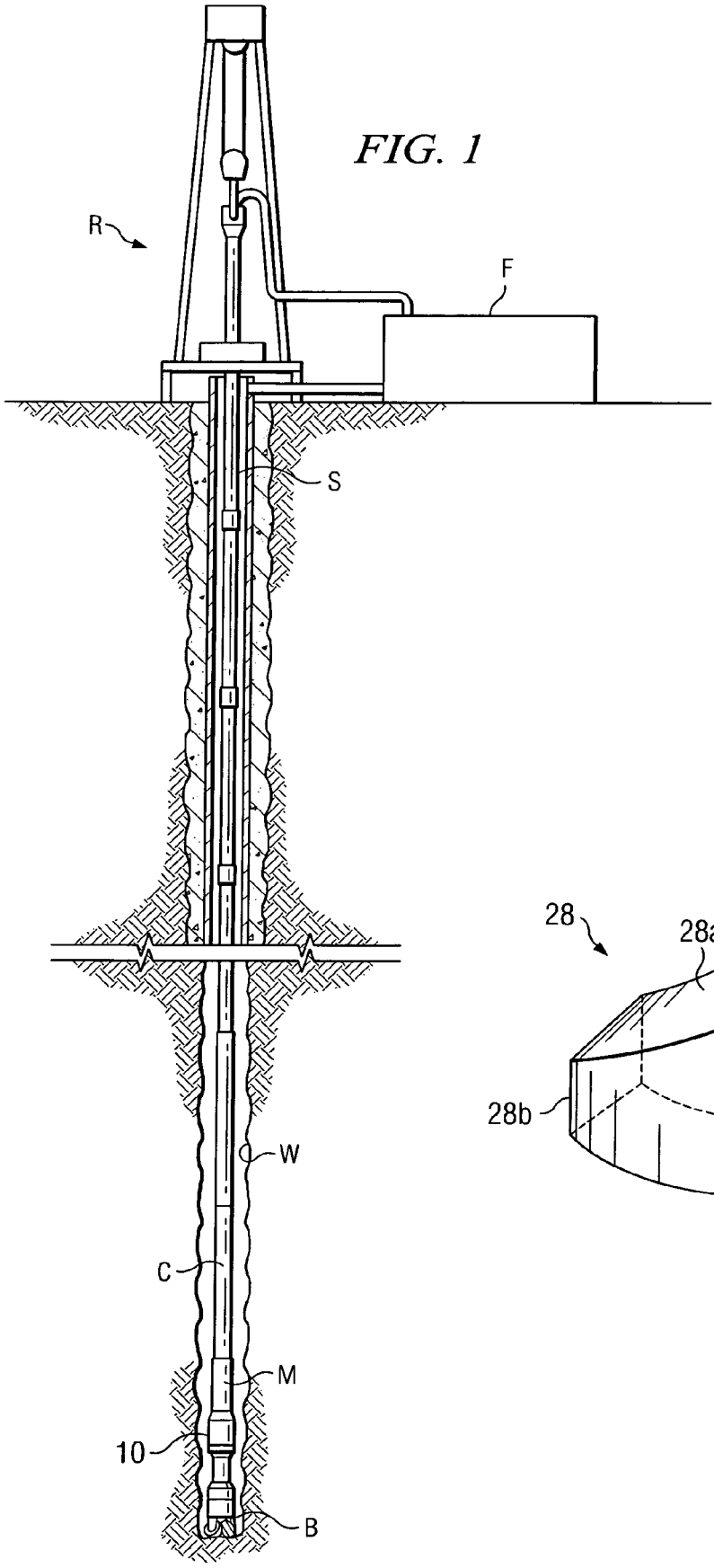
FIG. 1 is a vertical elevation, partially in section illustrating a drilling rig for drilling a well bore with the drilling system of the present invention.

FIG. 1 of the drawings illustrates a drill string, indicated generally by the reference letter S, extending from a conventional rotary drilling rig R and in the process of drilling a well bore W through an earth formation. The lower end portion of the drill sting S includes a drill collar C, a subsurface drilling fluid-powered motor M, and a drill bit B at the end of the string S. The bit B can either be in the form of a roller cone bit or fixed cutter bit. A drilling fluid supply system F circulates a drilling fluid, such as drilling mud, down through the drill string S for discharge through or near the bit B to assist in the drilling operation and promote cleanup. The fluid then flows back to the ground surface through an annulus defined between the well bore W and the drill string S. The well bore W is drilled by rotating the drill string S, and therefore the bit B, from the rig R in a conventional manner, and/or by rotating the bit B with rotary power supplied to the subsurface motor M by the circulating fluid in a manner to be described. Since all of the above components are conventional, they will not be described in detail.

Figure 2A:
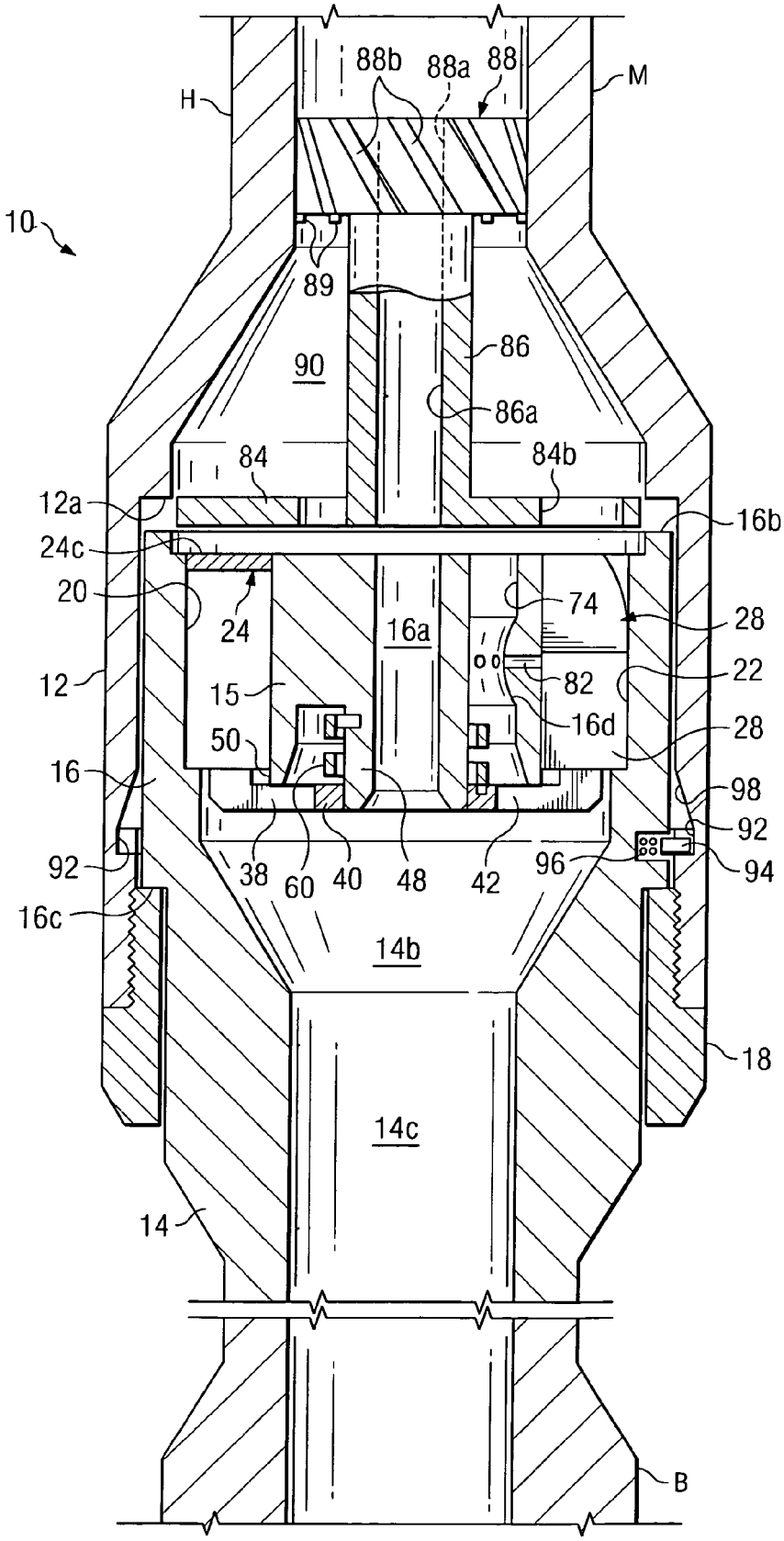
FIGS. 2A and 2B are partial longitudinal sectional views of a rotary impact generator according to an embodiment of the present invention depicting the generator in two operational positions.
Figure 2B:
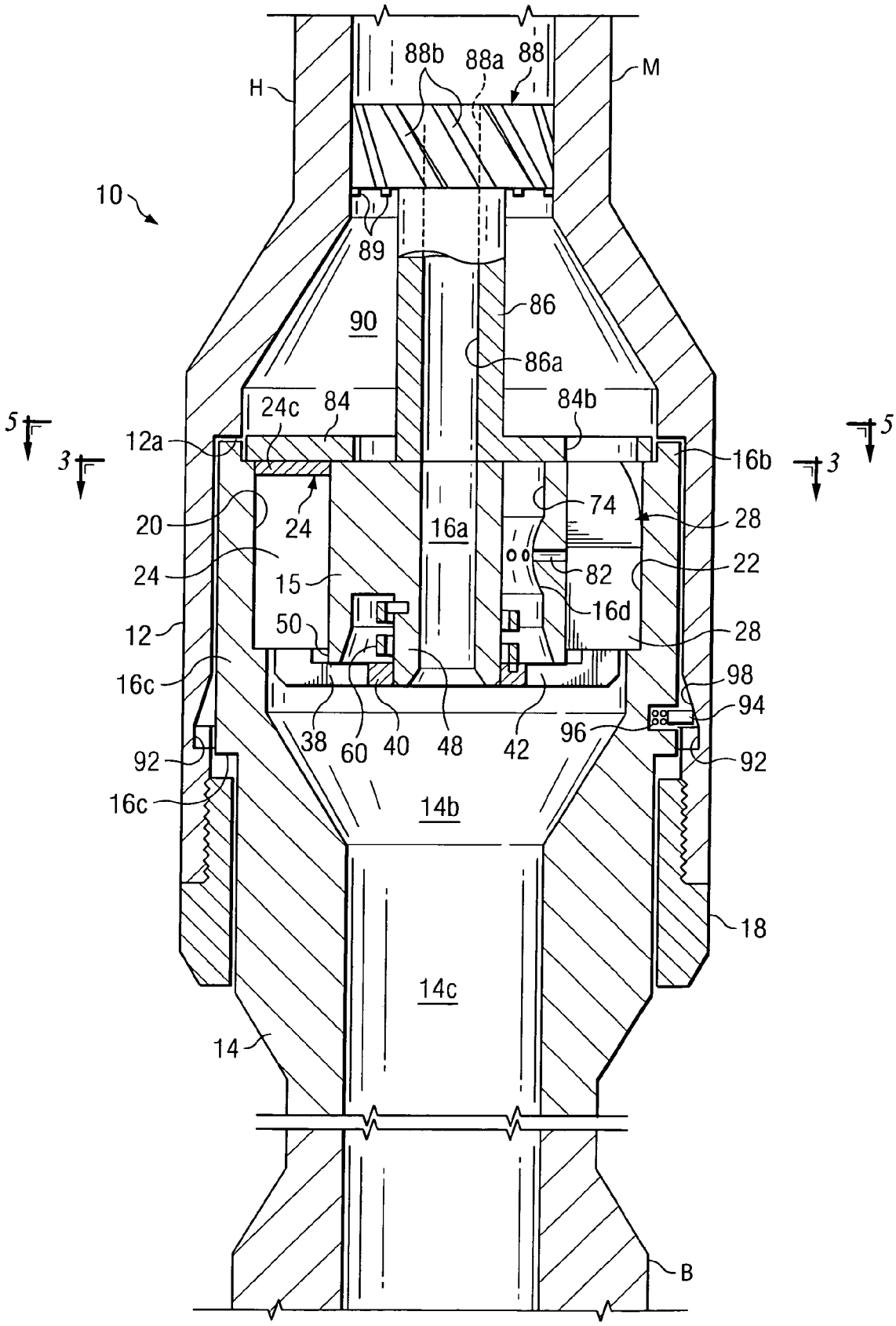

A rotary impact generator 10 according to an embodiment of the invention is connected in the drill string S between the motor M and the bit B for the purpose of utilizing the fluid flowing through the motor to create impact forces against the bit B. As depicted in FIGS. 2A and 2B, the impact generator 10 has an outer housing 12 formed at the lower end of a housing H of the motor M. Although shown as being an extension of, i.e. integral with, the housing H, it is understood that the housing 12 could be formed separately from, and attached to, the housing H.

A tubular bit shank 14 extends upwardly from the bit B and into the housing 12 where it tapers radially outwardly to form an integral solid cylindrical anvil 16. A central bore 14*a* is formed through the shank 14 and extends to a tapered bore 14*b* formed in the above tapered portion of the shank. Also, a bore 16*a* is formed through the anvil 16 which is in a coaxial relationship with the bore 14*b* and communicates with the bore. An outer annular flange 16*b* projects above the upper end of the anvil 16 to define a seat for a disc which will be described.

The anvil 16 is permitted to move axially over a limited range within the housing 12 in a manner to be described. To this end, a bushing 18 is threadedly engaged to the lower end portion of the housing 12, and is adapted to engage a shoulder 16*c* formed on the outer surface of the anvil 16 to retain the anvil in the housing 12 by limiting the downward axial movement of the anvil within the housing. An internal shoulder 12*a* is formed within the upper end portion of the housing 12 and is adapted to engage the upper surface of the flange 16*b* to limit the upward axial movement of the anvil 16 relative to the housing.

Figure 3:
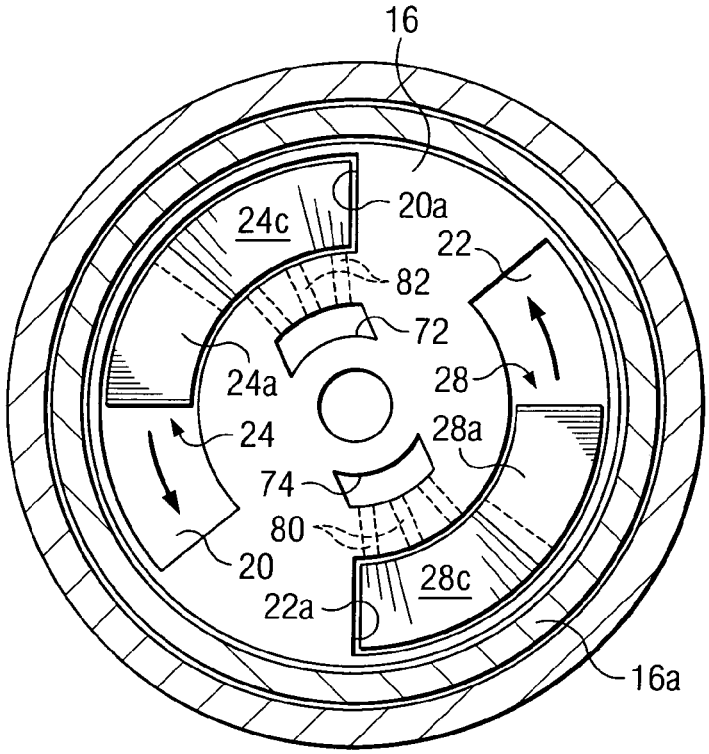
FIGS. 3 and 5 are transverse cross-sectional views taken along the line 3—3 and 5—5, respectively, of FIG. 2A.

Referring to FIGS. 2A and 3, two diametrically opposed, axially extending, arcuate chambers 20 and 22 are formed in the upper end portion of the anvil 16. Two arcuately shaped hammers 24 and 28 are disposed in the chambers 20 and 22, respectively, and are adapted for limited movement in the chambers under conditions to be described. The shape of the hammers 24 and 28 generally conform with the arcuate shape of the chambers 20 and 22, respectively, with the exception that the arcuate lengths of the chambers are greater than the arcuate lengths of the hammers 24 and 28, respectively, to permit the movement of the hammers within the chambers. The lower portions of the chambers 20 and 22 are in fluid flow communication with the bore 14*b* of the shank 14, for reasons to be described.

Figure 4:
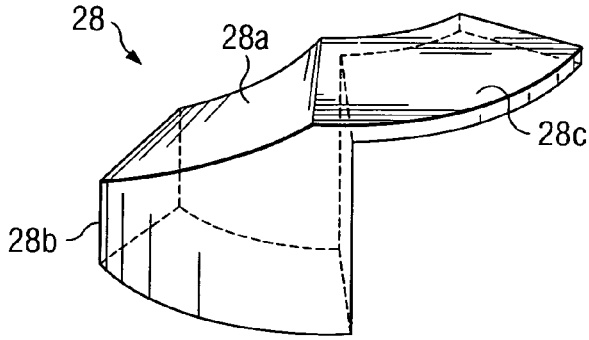
FIG. 4 is an isometric view of a component of the impact generator of FIGS. 2A and 2B.

The hammer 28 is shown in detail in FIG. 4, and includes a tapered drive surface 28*a* extending between an impact face 28*b* and a tongue guide 28*c*. The hammer 24 is identical to the hammer 28 and, as shown in FIG. 3, includes a tapered fluid drive surface 24*a* and a tongue guide 24*c*. The tongue guides 24*c* and 28*c* extend over corresponding slots formed in the upper surface of the anvil 16 as extensions of the chambers 20 and 22, respectively, to assist in aligning and guiding the movement of the hammers 24 and 28, respectively, and to block the flow of fluid into the chambers 20 and 22 under conditions to be described.

With reference to FIG. 2A, the hammer 24 is connected to the hammer 28 by a connector rod 38 extending from the base of the hammer 24 to a central connector ring 40, and a connector rod 42 extending from the ring 40 to the base of the hammer 28. The ring 40 is rotatably mounted about a depending central axle 48 machined into the anvil 16. The assembly formed by the hammers 24 and 28, the rods 38 and 42, and the ring 40 is adapted for limited rotational movement about the axle 48 and is fixed axially within the chambers 20 and 22 by an annular lip section 50 provided at the base of the chambers 20 and 22, respectively. A helical spring 60 is wrapped around the axle 48, with one end of the spring being fixed to the anvil 16 and the other end being fixed to the connector ring 40. Thus, when loaded in a manner to be described, the spring 60 applies a rotational biasing force to the hammers 24 and 28 in a clockwise direction as viewed in FIG. 3.

Referring to FIG. 3, two axially extending fluid bypass chambers 72 and 74 extend axially through the anvil 16 in a parallel relation to the chambers 20 and 22, respectively. As shown in FIG. 2A in connection with the chamber 74, a portion of the wall formed in the anvil 16 that defines the latter chamber is formed in the shape of axially extending venturi surface 16*d*, the purpose of which will be described. Although not shown in the drawings, a portion of the wall formed in the anvil 16 that defines the chamber 72 is also formed in the shape of axially extending venturi surface. The lower portions of the chambers 70 and 72 are in fluid flow communication with the bore 14*b* of the shank 14, for reasons to be described.

As shown in FIG. 3, a series of angularly spaced, radial passages 80 are formed in the anvil 16 and extend from the chamber 20 to the bypass chamber, and a series of angularly spaced, radial passages 82 extend from the chamber 22 to the bypass chamber 74. One of the passages 82 is shown in FIG. 2A.

Figure 5:
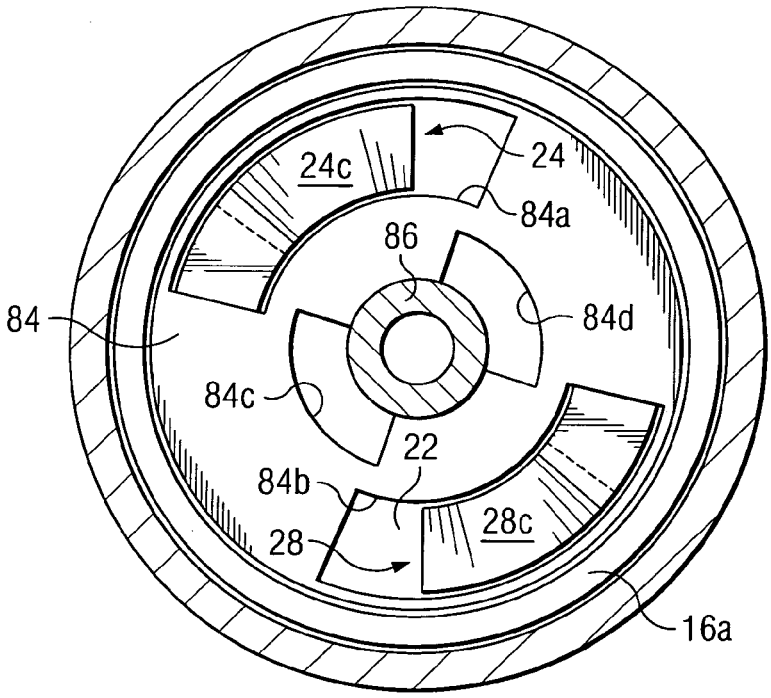

As shown in FIGS. 2A, and 5, a circular flow disc 84 is provided in the housing 12 above the upper end of the anvil 16. The disc 84 includes two diametrically opposed windows 84*a* and 84*b* that are shaped similarly to the chambers 20 and 22, respectively, but have shorter arcuate lengths than the chambers. Two additional diametrically opposed windows 84*c* and 84*d* are also formed through the disc 84 and are located radially inwardly, and are angularly spaced, from the windows 84*a* and 84*b*, respectively.

The disc 84 is integral with an axially extending tubular drive shaft 86 (FIG. 2A) that extends upwardly from the disc and to the lower portion of the motor M. A turbine head 88 is mounted in the housing H of the motor M and is connected to, or formed integrally with, the shaft 86. A central bore 88*a* extends through the head 88 and registers with a central axial bore 86*a* extending through the shaft 86 which, in turn, registers with the bore 16*a* of the anvil 16. Inclined fluid passages 88*b* are formed through the head 88 and react with fluid flowing through the motor housing H under conditions to be described to rotate the anvil, and therefore the shaft 86 and the disc 84. The head 88 is supported axially against downward axial movement by internal supports 89 projecting radially inwardly from the interior of the housing of the motor M. A chamber 90 is defined by the housings H and 12, the disc 84, the shaft 86, and the head 88.

A series of angularly spaced grooves 92 are formed in the inner wall of the housing 12, and one of the grooves is shown in FIG. 2A. One end portion of a plunger 94 extends in a notch formed in the outer surface of the anvil 16, and a coil spring 96 extends between the base of the notch and the latter end of the plunger 94 to urge the plunger radially outwardly. An annular continuous, frustoconical surface 98 is formed in the inner wall of the housing 12 and extends upwardly from each groove 92 and around the entire inner circumference of the housing. The surface 98 is tapered so that its diameter decreases in a direction from the lower end of the housing 12 to its upper end.

The anvil 16, and therefore the shank 14 and the bit B, move relative to the housing 12 between the positions shown in FIGS. 2A and 2B under conditions to be described. In the lower position of the anvil 16 shown in FIG. 2A, the upper end of the anvil 16 is in a spaced relation to the lower surface of the disc 84 and the plunger 94 is urged, by the spring 96, into engagement with a groove 92 in the housing 12 to couple the anvil to the housing.

In the upper position of the anvil 16 shown in FIG. 2B, its upper end engages the lower surface of the disc 84, and the plunger 94 is urged into engagement with the continuous surface 98 formed in the inner wall of the housing 12. In this position of the plunger 94, the anvil 16 is uncoupled from the housing 12.

In the upper position of the anvil 16 shown in FIG. 2B, when the disc 84 is rotated relative to the anvil 16 in the manner described above, the windows 84*a* and 84*b* (FIG. 5) periodically register with the chambers 20 and 22, and the windows 84*c* and 84*d* periodically register with the chambers 72 and 74. Since the windows 84*c* and 84*d* are angularly spaced from the windows 84*a* and 84*b*, the windows 84*c* and 84*d* register with the chambers 72 and 74, during periods when the windows 84*a* and 84*b* are not in registry with the chambers 20 and 22, and vice versa. The windows 84*a* and 84*b* are shown in registry with the chamber 20 and 22, respectively in FIG. 5, while the windows 84*c* and 84*d* are shown out of registry with the chambers 72 and 74.

In operation, it will be assumed that the anvil 16 is in its normal, lower position within the housing 12 as shown in FIG. 2A, with the plunger 94 extending in one of the grooves 92 to couple the anvil 16 to the housing 12, and with the anvil 16 spaced from the disc 84. It will also be assumed that the hammers 24 and 28 are in the positions in the chambers 20 and 22, respectively, shown in FIG. 3.

When the motor M is activated, the housings H and 12, and therefore the anvil 16, along with the shank 14 and the bit B, rotate in a clockwise direction shown in FIG. 3 to enable the bit B to perform its drilling operation with the weight of the drill string S (FIG. 1) applying a constant, axially directed force on the bit. Activation of the motor M also causes drilling fluid, usually in the form of mud, to flow from the motor M into and through the bores 88*a* and 86*a* to the relatively low pressure area between the lower surface of the disc 84 and the upper surface of the anvil 16, before passing directly into the areas of the chambers 20 and 22 not occupied by the hammers 24 and 28, respectively. The fluid then flows through the chambers 20 and 22 and, from the lower portions of the chambers, to the bore 14*b* of the rotating shank 14 and passes through the shank and the rotating bit B. The fluid is discharged from the bit B for the purpose of assisting in the drilling operation in a conventional manner and is then recirculated back to the fluid supply system F through the annulus between the drill string 16 and the well bore W. In this mode, the fluid from the motor bypasses the passages 88*b* in the head 88, and therefore the head and the disc 84 do not rotate. Thus, the hammers 24 and 28 are not affected by this continuous flow of fluid through the chambers 20 and 24.

The anvil 16 is maintained in its lower position of FIG. 2A during the drilling operation until the bit B drags or stops rotating as a result of encountering a relatively large load in the well bore W. When this happens, the anvil 16 is driven upwardly relative to the housing 12 to its upper position shown in FIG. 2B by the reactive forces of the load. In this upper position, the upper end of the anvil 16 engages the lower surface of the disc 84 to block the above-described flow of fluid between the anvil and the disc. Also, this movement of the anvil 16 to its upper position causes the plunger 94 to be moved upwardly through the top of the grooves 92 including the particular groove in which it extends, and into the continuous frustoconical surface 98, thus decoupling the anvil 16 from the housing 12. The anvil 16 is thus free to rotate relative to the housing 12, and damage to the motor M and associated components is prevented while the impact generator 10 can function in a manner to be described. It is noted that the force required to drive the anvil 16 upwardly relative to the surface 98 continuously increases as the anvil 16 moves upwardly relative to the housing 12, due to the decreasing radial dimension of the surface 98 and the bias of the spring 96 acting on the plunger 94.

Figure 7:
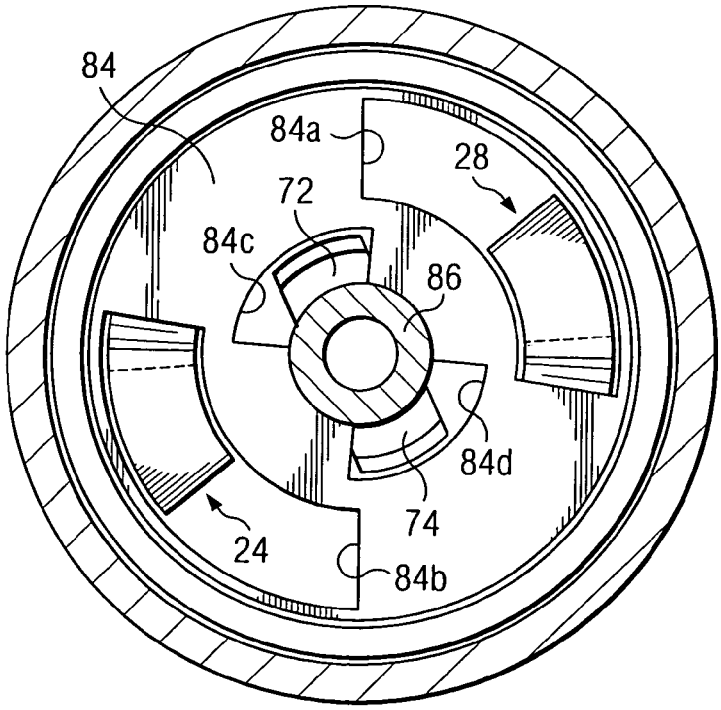

The blockage of flow between the anvil 16 and the disc 84 in accordance with the above also terminates fluid flow through the bores 88*a* and 86*a*. Thus, the fluid from the motor M flows through the passages 88*b* of the turbine head 88 and into the chamber 90. This fluid flow causes rotation of the head 88 and corresponding rotation of the shaft 86 and the disc 84. The two windows 84*a* and 84*b* of the rotating disc 84 thus periodically pass over, and register with, the two chambers 20 and 22 as shown in FIG. 5, permitting the high pressure fluid from the chamber 90 to selectively flow into the chambers 20 and 22 during this registration. Similarly, the windows 84*c* and 84*d* periodically pass over, and register with, the two bypass chambers 72 and 74, as shown in FIG. 7, permitting fluid flow into these chambers during periods when the windows 84*a* and 84*b* are not in registry with the chambers 20 and 22.

When the fluid periodically enters the chambers 20 and 22 under control of the rotating disc 84 in the manner described above, the fluid impacts against the tapered drive surfaces 24*a* and 28*a* of the hammers 24 and 28, respectively. As a result, the hammers 24 and 28 are forced to move in the chambers 20 and 22, respectively, in a counterclockwise direction, as viewed in FIG. 3, from the positions illustrated in FIG. 3 to the positions illustrated in FIG. 6. This movement of the hammers 24 and 28 also rotates the assembly formed by the hammers, the connector rods 38 and 42 (FIG. 2B), and the connector ring 40 to compress and load the coil spring 60. During this movement no fluid flow occurs from the chamber 90 to the bypass chambers 70 and 72 since the disc 84 blocks the latter chambers.

Figure 6:
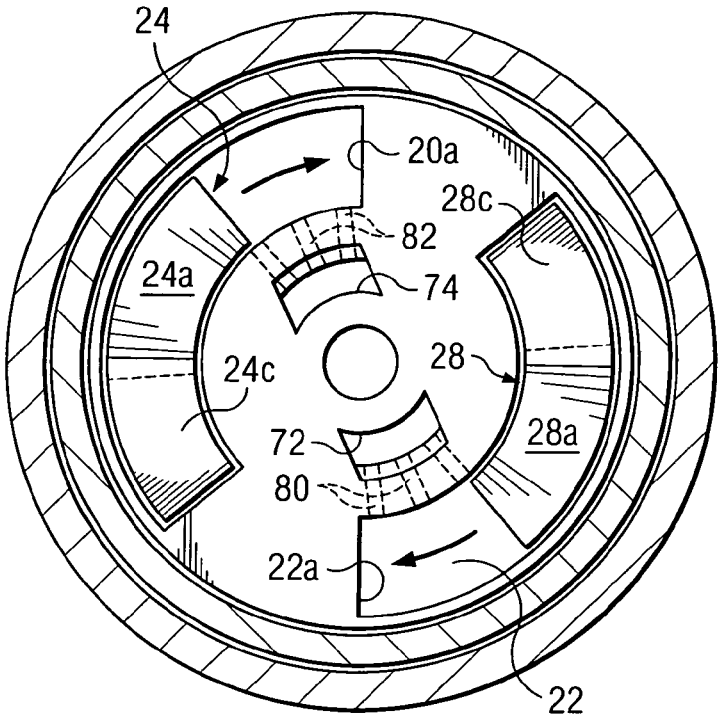
FIGS. 6 and 7 are views similar to FIGS. 3 and 5, respectively, but depicting different operational modes of the impact generator of FIGS. 2A and 2B.

In this cocked, or retracted, position of the hammers 24 and 28 shown in FIG. 6, further rotation of the disc 84 causes the slots 84*a* and 84*b* to more out or registry with the chambers 20 and 22 and the slots 84*c* and 84*d* to register with the bypass chambers 72 and 74. Therefore, fluid from the chamber 90 passes through the chambers 72 and 74 to the bore 14*a* and, in so doing, establishes low pressure zones by virtue of the venturi surface 16*d* (FIG. 2) associated with the chamber 74 and the identical venturi surface (not shown) associated with the chamber 72. This induces the fluid remaining in the chambers 20 and 22 to pass from the latter chambers, through the passages 80 and 82 and into the chambers 72 and 74, respectively, before discharging into the bore 14*a*. The fluid discharging into the bore 14*a* in accordance with the foregoing passes through the bit B to assist in the drilling operation and is recirculated back to the fluid supply F in the manner discussed above.

The location and angular spacing of the windows 84*a*–84*d* around the disc 84 are such that the above low pressure zone is established at approximately the same time as the termination of the above-described fluid forces on the hammers 24 and 28 though the windows 84*a* and 84*b* by virtue of the windows rotating out of registry with the chambers 20 and 22. Thus, the potenfial energy stored in the loaded spring 60 is released to rapidly rotate the hammers 24 and 28 in a clockwise direction from the position of FIG. 6 to the position of FIG. 3. This causes the face 28*b* (FIG. 2) of the hammer 28 and the face of the hammer 24 to strike the walls 22*a* and 20*a* (FIG. 6), respectively, of the anvil 16 to impart a percussion blow to the anvil and therefore to the bit B. This, in turn, imparts a circumferentially directed impact force against the formation engaging the bit B. During this impact drive the unoccupied areas of the chamber 20 and 22 behind the hammers 24 and 28 are covered by the tongue guides 24*c* and 28*c*, respectively.

As the disc 84 continues to rotate, the above operation cycle is repeated and the hammers 24 and 28 thus reciprocate back and forth within the anvil 16 and deliver the percussion blows as described.

Thus, the above eliminates, or at least considerably reduces, the above-mentioned problems associated with a bit that drags or stops rotating as a result of encountering a relatively large load in the well bore W while the attached drill string continues to turn. Also, this is achieved by a rotary, or circumferentially directed, impact force against the anvil 16, and therefore the drill bit B, without any associated, axially directed, percussive force being applied to the bit. Moreover, any problems associated with the sudden release of the bit are eliminated and the weight-on-bit is not reduced.

It is understood that variations may be made in the foregoing without departing from the scope of the invention. For example, it can be appreciated that the impacts generated on the bit according to the above embodiments can be achieved if the drill string is rotated independently of the above operation. Also, although the well bore and the drill string are shown extending vertically in the drawings, for the purpose of example, it is understood that the above embodiments also apply to a well bore that deviates from the vertical. Hence, the spatial references made above, such as "upward", "downward", "radial" "inward", outward", etc. are for the purpose of illustration only and do not limit the specific spatial orientation or location of the structure described. Moreover, the number of hammers, chambers in the anvil head, and slots in the disc can vary.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. An impact generating system for applying rotary percussive impacts to a drill bit, the system comprising:

an anvil for connection to the bit, a hammer disposed in the anvil for movement about the axis of the anvil in one direction, a device for storing energy in response to the movement of the hammer in the one direction and converting the energy into a force in a direction opposite the first direction for driving the hammer in the opposite direction and against a wall of the anvil to produce the percussive impacts;

a fluid flow system for directing fluid against the surface of the hammer to drive the hammer in the one direction; and a rotating disc in the path of the fluid flow and having at least one slot formed therein, so that the disc selectively directs the flow of the fluid against the hammer to cause the hammer to move in the one direction and selectively terminates the flow of the fluid against the hammer to permit the hammer to move in the opposite direction.

2. The system of claim 1 wherein a surface is provided on the hammer against which the fluid impacts for moving the hammer in the one direction.

3. The system of claim 1 wherein the hammer is disposed in a chamber that receives the fluid, and wherein the fluid is discharged from the chamber after the flow against the hammer has been terminated.

4. An impact generating system for applying rotary percussive impacts to a drill bit, the system comprising:

an anvil for connection to the bit;

a hammer disposed in the anvil for movement about the axis of the anvil in one direction;

a device for storing energy in response to the movement of the hammer in the one direction and converting the energy into a force in a direction opposite the first direction for driving the hammer in the opposite direction and against a wall of the anvil to produce the percussive impacts;

a fluid flow system for directing fluid against the hammer to drive the hammer in the one direction;

wherein the hammer is disposed in a chamber that receives the fluid and the fluid is discharged from the chamber after the flow against the hammer has been terminated;

a bypass chamber; and a passage connecting the bypass chamber to the first-mentioned chamber.

5. The system of claim 4 wherein the chambers are formed in the anvil.

6. The system of claim 4 wherein the bypass chamber is defined, at least in part, by a venturi surface that induces the flow of fluid from the first-mentioned chamber to the bypass chamber to permit the hammer to move in the opposite direction.

7. The system of claim 4 further comprising a control device for selectively directing the flow of the fluid into the chamber and against the hammer to cause the hammer to move in the one direction and for selectively terminating the flow of fluid against the hammer to permit the hammer to move in the opposite direction.

8. The system of claim 7 wherein the control device selectively directs the flow of fluid into the bypass chamber when it has terminated the flow of fluid into the first-mentioned chamber.

9. The system of claim 8 wherein the control device is a rotating disc in the path of the fluid flow and having at least two slots formed therein, so that the disc selectively directs the flow into the first-mentioned chamber and into the bypass chamber.

10. The system of claim 9 further comprising a turbine head connected to the disc and adapted to rotate in response to the flow of the fluid.

11. The system of claim 10 wherein the turbine head receives the fluid from a motor.

12. The system of claim 11 wherein the fluid is a drilling fluid that is directed to and through the drill bit to assist the bit in its drilling operation.

13. The system of claim 10 further comprising a housing connected to the motor and receiving the anvil and the turbine head.

14. The system of claim 13 wherein the housing is adapted to rotate with the motor and further comprising a clutch assembly for selectively coupling the anvil to the housing to rotate the anvil with the housing.

15. The system of claim 14 wherein the bit is connected to the anvil so that the bit is rotated when the anvil is coupled to the housing.

16. The system of claim 10 wherein the fluid bypasses the turbine head during the drilling operation and is passed through the turbine head to rotate the disc and impact the hammer when the bit drags or stops rotating as a result of encountering a relatively large load.

17. The system of claim 1 wherein the energy storage device is a spring connected between the hammer and the anvil that compresses in response to the movement of the hammer in the one direction and releases in response to the movement of the hammer in the opposite direction.

18. The system of claim 17 wherein the hammer moves circumferentially relative to the axis of the anvil.

19. A method for applying rotary percussive impacts to a drill bit, the method comprising:

connecting an anvil to the bit;

selectively directing fluid against a hammer to drive the hammer in one direction in the anvil when the bit encounters a relatively large load;

storing energy during the step of driving;

releasing the stored energy to drive the hammer in a direction opposite the first direction to produce the percussive impacts;

selectively terminating the flow of fluid against the hammer to permit the hammer to move in the opposite direction; and locating a disc in the path of the fluid flow and rotating the disc relative to, the anvil to selectively direct the flow of the fluid against the hammer and selectively terminate the flow of the fluid against the hammer.

20. The method of claim 19 wherein the hammer moves circumferentially relative to the axis of the anvil.

21. A method for applying rotary percussive impacts to a drill bit, the method comprising:

connecting an anvil to the bit;

discharging fluid against a hammer in one direction in the anvil when the bit encounters a relatively large load;

storing energy during the step of discharging;

releasing the stored energy to drive the hammer in a direction opposite the first direction to produce the percussive impacts;

providing a chamber in the anvil that receives the hammer and the fluid;

discharging the fluid from the chamber after the flow against the hammer has been terminated to permit the movement of the anvil in the opposite direction; and directing the fluid from the chamber to a bypass chamber in the anvil to permit the movement of the anvil in the opposite direction.

22. The method of claim 21 further comprising forming the bypass chamber by a venturi surface that induces the flow of fluid from the first-mentioned chamber to the bypass chamber.

23. The method of claim 22 wherein the fluid is a drilling fluid and further comprising directing the fluid from the chamber to the drill bit for assisting in the drilling operation.

24. The method of claim 22 further comprising locating a disc in the path of the fluid flow and rotating the disc relative to the anvil to selectively direct the flow of the fluid into the first-mentioned chamber and against the hammer and to selectively direct the flow of the fluid into the bypass chamber.

25. The method of claim 24 further comprising forming two slots in the disc so that the disc selectively directs the flow into the first-mentioned chamber and into the bypass chamber.

26. The method of claim 24 further comprising passing the fluid through a turbine head connected to the disc for rotating the head and the disc.

27. The method of claim 24 further comprising directing the fluid so that it bypasses the turbine head during the drilling operation and so that it passes through the turbine head to rotate the disc and impact the hammer when the bit drags or stops rotating as a result of encountering a relatively large load.

28. An impact generating system for applying rotary percussive impacts to a drill bit, the system comprising:

an anvil for connection to the bit, a hammer disposed in the anvil for movement about the axis of the anvil in one direction, a fluid flow system for directing fluid against the hammer to drive the hammer in the one direction; and a rotating disc in the path of the fluid flow and having at least one slot formed therein, so that the disc selectively directs the flow of the fluid against the hammer to cause the hammer to move in the one direction and selectively terminates the flow of the fluid against the hammer to permit the hammer to move in the opposite direction.

29. The system of claim 28 wherein a surface is provided on the hammer against which the fluid impacts for moving the hammer in the one direction.

30. The system of claim 28 further comprising a device for storing energy in response to the movement of the hammer in the one direction and converting the energy into a force in a direction opposite the first direction for driving the hammer in the opposite direction and against a wall of the anvil to produce the percussive impacts.

31. The system of claim 28 wherein the hammer moves circumferentially relative to the axis of the anvil.

* * * * *